United States Patent [19]

Hirata et al.

[11] 4,404,428

[45] Sep. 13, 1983

[54] DETECTOR FOR SUB SIGNAL OF MODULATED AM STEREOPHONIC SIGNAL

[75] Inventors: Hitoshi Hirata; Akira Nishioka, both of Tokyo, Japan

[73] Assignee: Pioneer Electronic Corporation, Tokyo, Japan

[21] Appl. No.: 232,270

[22] Filed: Feb. 6, 1981

[30] Foreign Application Priority Data

Feb. 7, 1980 [JP] Japan ..... 55-13963

[51] Int. Cl.[3] ..... H04H 5/00

[52] U.S. Cl. ..... 179/1 GS; 307/512; 328/155

[58] Field of Search ..... 179/1 GD, 1 GS; 307/511, 512; 328/133, 134, 155; 455/256–261

[56] References Cited

U.S. PATENT DOCUMENTS 4,159,398 6/1979 Hilbert et al. ..... 179/1 GS
4,215,316 7/1980 Yamaguchi et al. ..... 179/1 GS
4,273,958 6/1981 Hirata ..... 179/1 GS
4,339,631 7/1982 Nishioka ..... 179/1 GS

*Primary Examiner*—A. D. Pellinen
*Attorney, Agent, or Firm*—Sughrue, Mion, Zinn, Macpeak and Seas

[57] ABSTRACT

A detector for a modulated AM stereophonic signal of simple configuration in which the sub signal of the stereophonic signal is detected accurately independent of fluctuations in the frequency of the carrier signal. In the detector circuit, the output phase of a VCO in a PLL circuit which is fed with an amplitude limited signal corresponding to the output of an IF amplifier in the receiver is controlled by a variable phase shifter that performs phase shifting according to a control voltage. The phase-controlled output is used as a synchronous detection signal for sub signal detection. The control voltage is produced to correspond to the phase difference between the phase-controlled signal and the carrier signal of the received AM stereophonic signal.

7 Claims, 4 Drawing Figures

DETECTOR FOR SUB SIGNAL OF MODULATED AM STEREOPHONIC SIGNAL

BACKGROUND OF THE INVENTION

The present invention relates to a detector for the sub signal of a modulated AM stereophonic signal. More particularly, the invention relates to a sub signal detector for use in a circuit for demodulating compatible quadrature AM stereophonic signals that can also be received by a monophonic AM receiver.

A modulated AM stereophonic signal $e_s(t)$ supplied by a compatible quadrature PM system can gradually be represented by the following formulas:

$$e_s(t)=\{1+L(t)+R(t)\}\cos(\omega_c t+\phi) \quad (1)$$

$$\phi=\tan^{-1}\{L(t)-R(t)\}/\{1+L(t)+R(t)\} \quad (2)$$

where L(t) and R(t) represent the left and right channel signals, respectively, and $\omega_c$ represents the angular frequency of the carrier signal. A method for demodulating a modulated AM stereophonic signal of this type is known by which the main signal, L(t)+R(t), is envelope detected and the sub signal, L(t)−R(t) is synchronously detected. A diagram of a circuit operating by this detection method is shown in FIG. 1.

The received high-frequency signals, represented by the formulas (1) and (2), are converted to an IF (intermediate frequency) signal $e_i$ by a frequency converter circuit (not shown) and amplified by an IF amplifier 3. The IF signal $e_i$ is supplied to an envelope detector 4 where only the amplitude component of the signal is detected to provide the main signal, L(t)+R(t). The IF signal $e_i$ is also supplied to a divider circuit 5 where the phase-modulated component cos $\phi$ is removed, as described herein, and supplied to a synchronous detector 1. In the synchronous detector 1, the output of the divider 5 is synchronously detected with a signal sin $\omega_i t$ which is 90 degrees out of phase with the carrier signal to provide the sub signal, L(t)−R(t). Both main and sub signals are supplied to a matrix circuit 2 for demodulation into right and left channel signals.

The circuit of FIG. 1 includes a PLL (phase-locked loop) circuit 10 which provides a cos $\phi$ and sin $\omega_i t$ components for the divider 5 and synchronous detector 1. In the circuit 10, the IF signal $e_i$ is subjected to amplitude limitation by a limiter 6 to provide a generally rectangular signal cos $(\omega_i t+\phi)$ which is free of the amplitude-modulated component. The output signal from the limiter 6 is supplied to a 90° phase comparator 7 where it is frequency- and phase-compared with the output $e_o$ of a VCO (voltage-controlled oscillator) 11. The comparator output $V_1$ is passed through a LPF (low-pass filter) 8 and amplified by a DC amplifier 9 the output of which is used for controlling the VCO 11. The VCO 11 has a free-running frequency $\omega_o$ equal to that of the IF signal $e_i$ so that the PLL circuit 10 is locked to the input angular frequency $\omega_i$ in such a manner that it is 90 degrees out of phase with the input signal. Since the output signal $e_o$ of the VCO 11 is sin $\omega_i t$, it can be used as a switching signal for the synchronous detector 1. The signal $e_o$ is also supplied to a 90° phase shifter 12 where it is phase-shifted by 90 degrees to provide a signal cos $\omega_i t$ which is supplied to one input of a synchronous phase detector 13, the other input of which is fed with the output cos $(\omega_i t+\phi)$ of the limiter 6, to provide the cos $\phi$ signal which is used as a division signal.

The following equation represents the action of the synchronous phase detector 13:

$$\cos(\omega_i+\phi)\cdot\cos\omega_i t=\tfrac{1}{2}\{\cos\phi+\cos(2\omega_i t+\phi\}. \quad (3)$$

Hence, by removing the cos $(2\omega_i t+\phi)$ component with a filter, the cos $\phi$ component is provided.

The formula for the IF signal $e_i$ that is represented on the basis of the formulas (1) and (2) can be rearranged to the following:

$$\begin{aligned} e_i &= (1+L+R)\cdot\cos(\omega_i t+\phi) \\ &= (1+L+R)\cdot\cos(\omega_i t\cdot\cos\phi+\sin\omega_i t\cdot\sin\phi) \\ &= \{(1+L+R)\cdot\cos\omega_i t+(L-R)\cdot\sin\omega_i t\}\cos\phi. \end{aligned} \quad (4)$$

(Here, with respect to $e_i$, L and R, (t) indicating that these signals are functions of time, has been omitted.) In the divider circuit 5, the IF signal $e_i$ represented by the formula (4) is divided by the synchronous phase detection output cos $\phi$ to remove the cos $\phi$ component and provide an output which is represented by:

$$e_i/\cos\phi=(1+L+R)\cos\omega_i t+(L-R)\sin\omega_i t. \quad (5)$$

The division output represented by the formula (5) is supplied to the synchronous detector 1 where it is switched by the signal sin $\omega_i t$ into an (L−R) signal, that is, the sub signal.

The phase comparator 7 of the PLL circuit 10 delivers an output voltage $V_1$ proportional to the cosine of the phase difference $\Delta\phi_e$ between two input signals which is represented by:

$$\Delta\phi_e=\cos^{-1}\Delta\omega/K_d \quad (6)$$

where $K_d$ is the loop gain of the PLL circuit and $\Delta\omega$ represents the difference between the angular frequency $\omega_i$ of the input signal $e_i$ and the free-running frequency $\omega_o$ of the VCO 11.

As is clear from the formula (6), when $\Delta\omega$ is zero or when the input signal $e_i$ is equal to the free-running frequency of the VCO 11, $\Delta\phi_e$ is 90 degrees and the output $e_o$ of VCO 11 is 90 degrees out of phase with the input signal $e_i$ thus achieving accurate detection of the sub signal. However, if the frequency of, for example, a local oscillation signal fluctuates slightly due to temperature drift or other factors, the frequency of the IF signal will also fluctuate, and as a consequence, $\Delta\omega$ in the formula (6) is not zero. In this case, $\Delta\phi_e$ varies with $\Delta\omega$ as indicated by the formula (6) and the relation between the two parameters is typically represented by the solid line 201 in FIG. 2. If there is a difference between the free-running frequency of the VCO 11 and the frequency of the input signal $e_i$, the output $e_o$ of VCO 11 is locked to the frequency of the input signal but it is not of phase with the input signal by a certain amount $\Delta\omega_e$. This makes accurate detection of the sub signal impossible.

SUMMARY OF THE INVENTION

Accordingly, an object of the invention is to provide a detector of simple circuit configuration with which the sub signal of a modulated AM stereophonic signal is detected accurately.

In accordance with this and other objects, the invention provides a detector for the sub signal of a modulated AM stereophonic signal in which the output phase of a VCO in a PLL circuit which is fed with an amplitude limited signal for a modulated AM stereophonic signal is controlled by a variable phase shifter that performs phase shifting according to a control voltage. The phase-controlled output is used as a synchronous detection signal for sub signal detection. The control voltage corresponds to a signal that represents the phase difference between the phase-controlled signal and the carrier signal of a received AM stereophonic signal.

More specifically, the invention provides a detector for an AM stereophonic signal including 90° out-of-phase signal generating means for generating in response to the AM stereophonic signal the carrier signal of which is amplitude-modulated by a signal corresponding to the sum of first and second channel signals and which is phase-modulated by a predetermined function of the channel signals, a signal which is 90 degrees out of phase with the carrier signal. In-phase signal generating means shifts the phase of the 90° out-of-phase signal to generate a signal which is in phase with the carrier signal. Detection means operates in response to the 90° out-of-phase signal and the in-phase signal to detect from the AM stereophonic signal a sub signal corresponding to the difference between the first and second channel signals. The 90° out-of-phase signal generating means includes a phase-locked circuit including a voltage-controlled oscillator. An input of the phase-locked loop is coupled to a source of an amplitude limited signal corresponding to the modulated AM stereophonic signal. A variable phase shifter shifts the output phase of the output signal from the voltage-controlled oscillator of the phase-locked loop circuit according to a control voltage produced by a phase comparator. The phase comparator compares the phase of an output of the variable phase shifter with that of the carrier signal to generate the control voltage according to the phase difference therebetween. The 90° out-of-phase signal is produced at the output of the variable phase shifter.

DESCRIPTION OF THE PREFERRED EMBODIMENTS

Figure 1:
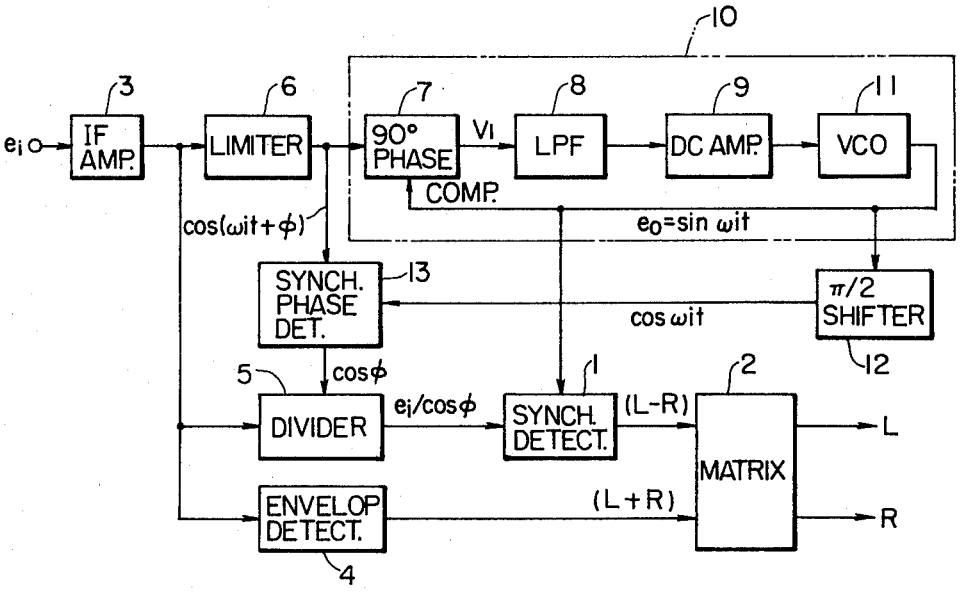
FIG. 1 PRIOR ART
FIG. 1 is a block diagram representing part of a conventional AM stereophonic signal receiver.
Figure 3:
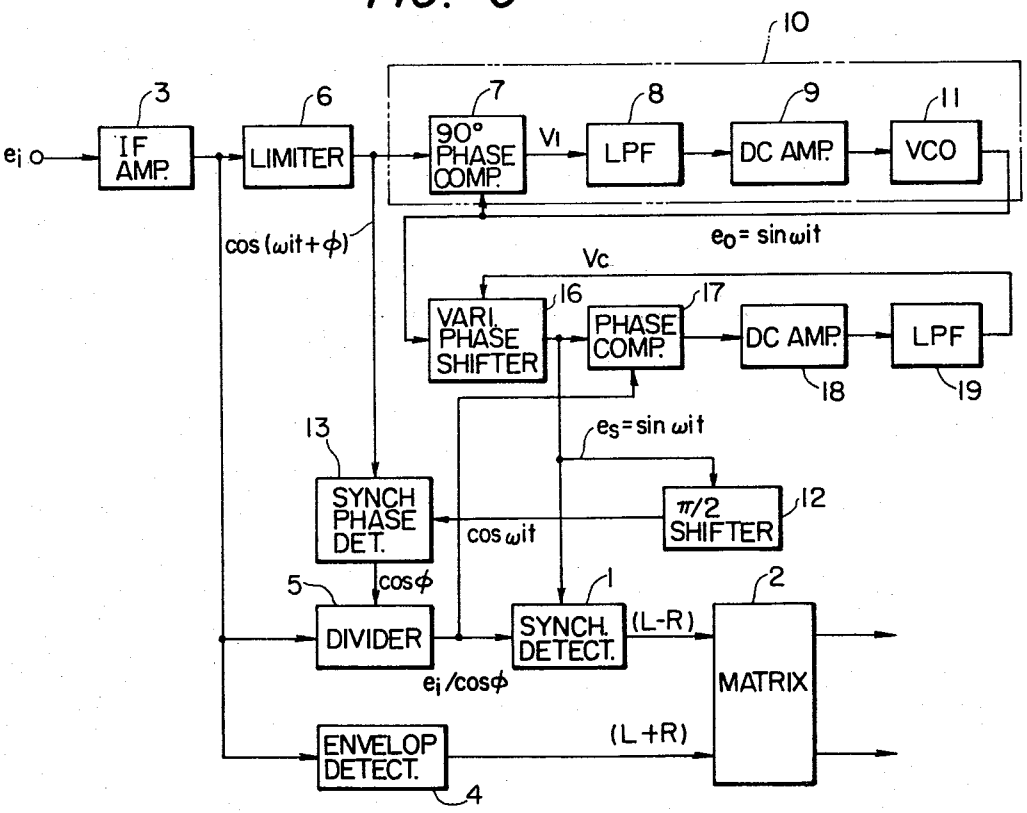
FIG. 3 is a block diagram of a preferred embodiment of a detector of the invention.

FIG. 3 is a block diagram of a preferred embodiment of a detector of the invention in which components corresponding to those in FIG. 1 are identified by like numerals. In the circuit of FIG. 3, the output $e_o$ of the VCO 11 is supplied to both the input of the phase comparator 7 and the input of a voltage-controlled variable phase shifter 16. The output of the phase shifter 16 is supplied to one input of a phase comparator 17 to the other input of which the output of the divider 5 is fed. The output of the phase comparator 17 is a signal that represents the phase difference between the two input signals. The difference signal is supplied to a DC amplifier 18 and a LPF 19 where it is converted into a DC voltage $V_c$ which serves as a control voltage for the variable phase shifter 16. The output $e_s$ of the phase shifter 16 is used as a switching signal for the synchronous detector 1 for the sub signal.

Figure 2:
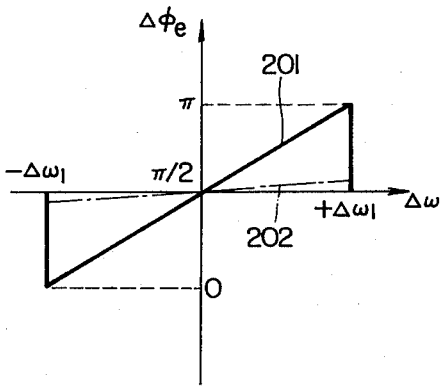
FIG. 2 is a diagram comparing the characteristics of the circuit of FIG. 1 with those of a detector circuit of the invention.

The circuit of FIG. 3 is so designed that when the frequency of the IF signal $e_i$ is equal to the free-running frequency of VCO 11, the carrier signal component of the signal $e_i$ and the output $e_o$ of the VCO 11 are out of phase by 90 degrees but the variable phase shifter 16 imposes no phase shift on its input signal. In such a circuit configuration, if for some reason, the input signal $e_i$ has a frequency $f_i$ that differs from the free-running frequency $f_o$ of VCO 11, the PLL circuit 10 is actuated to cause the VCO 11 to quickly produce an output $e_o$ having a frequency of $f_i$, whereupon the phase of the output varies in proportion to $|f_i - f_o|$ and is phase-locked in such a manner that it is $90° \pm \alpha$ out of phase with the input signal. Accordingly, the phase comparator 17 delivers an output proportional to $90° \pm \alpha$. This output is passed through the DC amplifier 18 and LPF 19 to produce a control voltage $V_c$ used to control the amount of phase shift imposed by the variable phase shifter 16. Thus, the output $e_o$ of the VCO 11 is controlled by the phase shifter 16 so that the output $e_s$ and input signal $e_i$ are out of phase by 90 degrees. In consequence of this, a signal $e_s$ that is about 90 degrees out of phase with the input signal $e_i$ and which has a frequency equal to that of the input signal is obtained within the locking range (equivalent to $\pm\Delta\omega_i$) of the PLL circuit 10 as shown by a dashed line 202 in FIG. 2. Therefore, the circuit of FIG. 3 continuously provides a signal that is in phase with the input signal $e_i$ and a signal 90 degrees out of phase with the input signal thereby assuring accurate detection of the sub signal.

Figure 4:
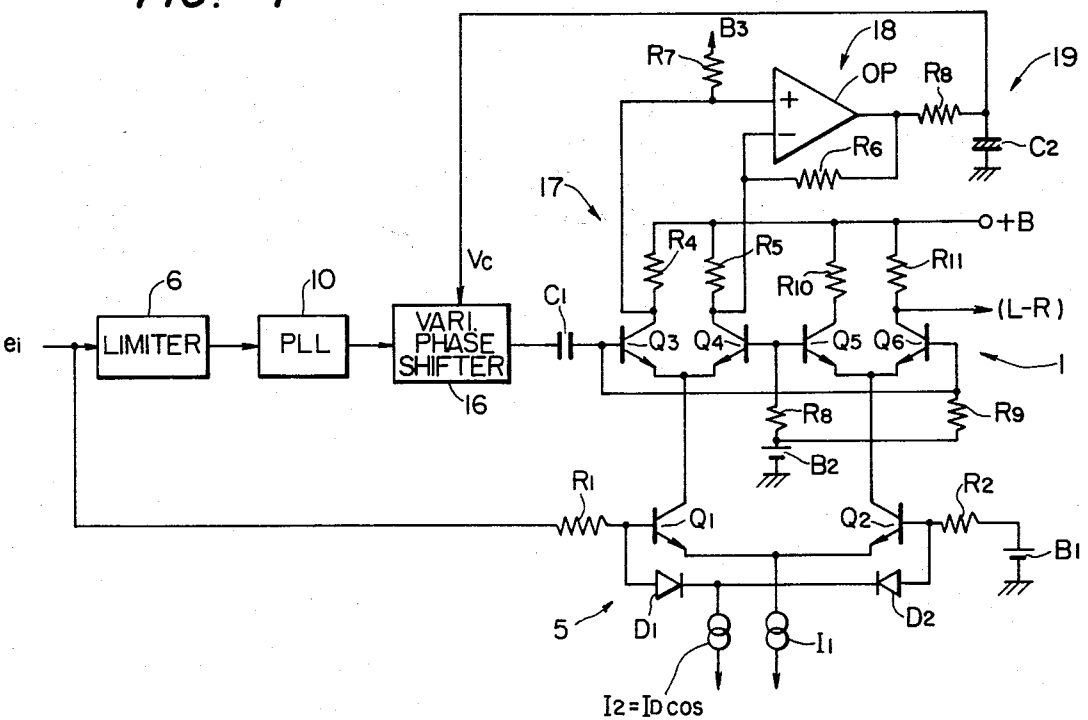
FIG. 4 is a diagram representing part of the circuit of FIG. 3.

FIG. 4 is a circuit diagram representing part of the circuit of FIG. 3 according to a preferred embodiment thereof. The divider 5 has a differential circuit configuration, made up of transistors $Q_1$ and $Q_2$ and a current source $I_1$, as well as a current source $I_2$ which provides a current proportional to the cos $\phi$ signal component obtained as an output from the synchronous phase detector 13. The current is applied to the base input of the transistors $Q_1$ and $Q_2$ through PN junction devices such as diodes $D_1$ and $D_2$, which may be replaced by transistor-connected diodes. The base of the transistor $Q_1$ is supplied with the IF signal $e_i$ through a resistor $R_1$ and the base of the transistor $Q_2$ is supplied with a reference voltage $B_1$ through a resistor $R_2$. A signal component of $\pm e_i/\cos\phi$ is produced at the collector output of each of the transistors $Q_1$ and $Q_2$. The operating principle of the differential circuit is well known and needs no further description.

Then, as is clear from the formula (5), the differential circuit delivers division outputs free of the phase-modulated component. One of the division outputs, a current flowing through the transistor $Q_1$, is used as a current source in a differential circuit made up of transistors $Q_3$ and $Q_4$ which circuit forms a phase comparator 17. The output of the variable phase shifter 16 is supplied to the base of the transistor $Q_3$ through a capacitor $C_1$ providing a multiplier configuration. In FIG. 4, $R_4$ and $R_5$ are collector load resistors for the transistors $Q_3$ and $Q_4$, respectively.

With the circuit arrangement described above, a signal that represents the phase difference between the $e_i/\cos\phi$ signal and the output signal of the variable phase shifter 16 is provided across the two collector outputs. This signal is supplied as a differential input to a DC amplifier 18 composed of resistors $R_6$ and $R_7$ and an operational amplifier OP. The amplified signal from the DC amplifier 18 is supplied to a LPF 19 composed of a resistor $R_8$ and a capacitor $C_2$ to produce a control voltage $V_c$ for the variable phase shifter 16.

The other differential output of the division output 5, namely the collector current of the transistor $Q_2$, is used as a current source in a differential circuit made up of transistors $Q_5$ and $Q_6$, which circuit forms a synchronous detector 1. The base of the transistor $Q_6$ is supplied with the output of the variable phase shifter 16 as a switching signal for synchronous detection also providing a multiplier configuration. In FIG. 4, $R_{10}$ and $R_{11}$ are collector load resistors.

In the circuit arrangement described above, the current source represented by the formula (5) is switched by sin $\omega_i t$ to provide a signal amplitude synchronous with sin $\omega_i t$ in the formula (5), specifically, a sub signal (L−R). In FIG. 4, a reference voltage source $B_2$ and resistors $R_8$ and $R_9$ form a base biasing circuit for the differential transistors. As illustrated by FIG. 4, the sub carrier detector of the invention has a very simple circuit configuration that is highly adaptive for fabrication on an IC chip and hence a detector of very small size can be produced using the concept of the invention.

As discussion above, a great advantage of the invention is that a detector is provided that assures accurate detection of the sub signal irrespective of fluctuations in the frequency of the IF signal.

What is claimed is:

1. A detector for an AM stereophonic signal comprising:

a limiter, having an input coupled to receive an AM stereophonic IF signal, for producing an amplitude limited signal having a frequency and phase determined by a frequency and phase of said IF signal;

a phase-locked loop circuit for producing a first reference signal which is 90° out of phase with said amplitude limited signal, said phase-locked loop circuit comprising a 90° first phase comparator having a first input connected to receive said amplitude limited signal, a first low-pass filter having a input connected to an output of said 90° first phase comparator, a first DC amplifier having an input connected to an output of said first low-pass filter, and a voltage-controlled oscillator having an input connected to an output of said DC amplifier and an output connected to a second input of said 90° first phase comparator, said first reference signal being produced at said output of said voltage-controlled oscillator;

a phase correction circuit for correcting a phase of said first reference signal for producing a second reference signal having a phase substantially precisely 90° out of phase with a phase of said IF signal, said phase correction circuit comprising a variable phase shifter having a signal input connected to receive said first reference signal, a second phase comparator having a first input connected to an output of said variable phase shifter and a second input connected to receive a signal having a phase determined by a carrier signal of said IF signal, a second DC amplifier having an input connected to an output of said second phase comparator, and a second low-pass filter having an input connected to an output of said DC amplifier and an output connected to a control input of said variable phase shifter, said second reference signal being produced on said output of said variable phase shifter;

a 90° phase shifter for producing a third reference signal by shifting a phase of said second reference signal 90°;

and demodulating circuit means receiving said IF signal and said second and third reference signals for producing a sub signal corresponding to a difference between first and second channel signals contained in said stereophonic AM signal.

2. The detector according to claim 1 wherein said demodulating circuit means comprises a synchronous phase detector operating in response to said third reference signal and said amplitude limited signal to detect the phase-modulated component of said amplitude limited stereophonic signal; a divider for dividing said IF signal by an output of said synchronous phase detector; and a synchronous detector for synchronously detecting an output of said divider with said second reference signal to thereby produce said sub signal.

3. The detector according to claim 2 wherein said divider comprises a differential circuit which is supplied with said IF signal; and a current source for producing a current in response to said output of said synchronous phase detector, an output of said current source being applied to two differential inputs of said differential circuit through PN junction devices, wherein said second phase comparator comprises a differential circuit to which is coupled said output of said variable phase shifter and a first output of said differential circuit of said divider as a current source, and said synchronous detector comprises a differential circuit to which is coupled said output of said variable phase shifter and a second output of said differential circuit of said divider as a current source.

4. The detector according to claim 2 wherein said second input of said second phase comparator is connected to said output of said divider.

5. A detector for an AM stereophonic signal comprising:

a limiter having an input coupled to an output of an IF amplifier; a phase-locked loop circuit having an input coupled to an output of said limiter, said phase-locked loop circuit comprising a 90° phase comparator, a low-pass filter, a DC amplifier, and a voltage-controlled oscillator coupled in series in the stated order, an output of said voltage-controlled oscillator being coupled to a control input of said 90° phase comparator and a signal input of said 90° phase comparator being coupled to said output of said limiter; a variable phase shifter, a phase comparator, a second DC amplifier, and a second low-pass filter coupled in series in the stated order, an output of said second low-pass filter being coupled to a control input of said variable phase shifter and a signal input of said variable phase shifter being coupled to said output of said voltage-controlled oscillator; a 90° phase shifter having an input coupled to an output of said variable phase shifter; a synchronous phase detector having a first input coupled to said output of said limiter and a second input coupled to an output of said 90° phase shifter; a a divider circuit having a dividend input coupled to said output of said IF amplifier and a divisor input coupled to an output of said synchronous phase detector; a synchronous phase detector having a signal input coupled to an output of said divider and a detection signal input coupled to an output of said variable phase shifter, said output of said divider being coupled to a control input of said phase comparator; an envelope detector having an input coupled to said output of said IF amplifier; and a matrix detector having inputs coupled to an output of said synchronous detector and said envelope detector.

6. The detector of claim 4 wherein said divider comprises first and second transistors coupled in a differential circuit, emitters of said transistors being coupled to a constant current source and bases of said transistors being coupled through diodes to said output of said synchronous phase detector, a base of said first transistor being coupled to said output of said IF amplifier and a base of said second transistor being coupled through a resistor to a constant voltage source.

7. The detector of claim 4 wherein said phase comparator comprises third and fourth transistors coupled in a differential circuit with emitters of said third and fourth transistors being coupled to a collector of said first transistor; and wherein said synchronous detector comprises fifth and sixth transistors coupled in a differential circuit, emitters of said fifth and sixth transistors being coupled to a collector of said second transistor, a base of said third transistor being coupled to a base of said sixth transistor, said output of said variable phase shifter and through a resistor to a second constant voltage source, and a base of said fourth transistor being coupled to a base of said fifth transistor and through a resistor to said second constant voltage source, collectors of said third and fourth transistors being coupled to said second DC amplifier.

* * * * *